US005174189A

United States Patent [19]

Kamimura

[11] Patent Number: 5,174,189

[45] Date of Patent: Dec. 29, 1992

[54] FLUID CONTROL APPARATUS

[75] Inventor: Toshio Kamimura, Gifu, Japan

[73] Assignee: Teijin Seiki Co., Ltd., Osaka, Japan

[21] Appl. No.: 776,696

[22] Filed: Oct. 16, 1991

Related U.S. Application Data

[63] Continuation-in-part of Ser. No. 362,854, Jun. 7, 1989.

[30] Foreign Application Priority Data

Jun. 8, 1988 [JP] Japan ..... 63-141156
Jun. 8, 1988 [JP] Japan ..... 63-141157

[51] Int. Cl.[5] ..... F15B 11/08

[52] U.S. Cl. ..... 91/446; 91/464; 91/466

[58] Field of Search ..... 91/464, 466, 468, 360, 91/461, 453, 446; 60/403, 406

[56] References Cited

U.S. PATENT DOCUMENTS

| | | | |
|---|---|---|---|
| 3,792,715 | 2/1974 | Parrett et al. | 91/420 |
| 3,943,968 | 3/1976 | Treichler | 91/420 |
| 4,090,429 | 5/1978 | Kamimura | 91/466 |
| 4,433,615 | 2/1984 | Vick | 91/420 |
| 4,609,019 | 9/1986 | Hutson | 91/451 |
| 4,667,570 | 5/1987 | Jensen, Jr. et al. | 91/446 |

OTHER PUBLICATIONS

Resnick et al., *Physics*, Third Edition, John Wiley & Sons, 1977, p. 122.

*Primary Examiner*—Edward K. Look

*Assistant Examiner*—Christopher M. Verdier

*Attorney, Agent, or Firm*—Rothwell, Figg, Ernst & Kurz

[57] ABSTRACT

A fluid control apparatus which communicates a fluid cylinder with a fluid supply passage and a return passage, and a piston of the fluid cylinder is connected to a spoiler of an airplane.

The fluid control apparatus comprises a hydraulic passage and a check valve. The hydraulic passage is capable of communicating with cylinder chambers located at both sides of the piston. The check valve is opened by hydraulic pressure generated by backward movement of the piston.

The fluid control apparatus has a blow down valve characteristic so that the piston is allowed to move only in one direction by an external force when supply of fluid to the actuator is stopped because at least one of the supply passage and the return passage is damaged.

The fluid control apparatus further has a retainer and a manually operable member.

The retainer communicates the return passage with the hydraulic passage capable of communicating with cylinder chambers of the actuator. The manually operable member is used to located the retainer at a position wherein the return passage is communicated with the hydraulic passage.

According to the fluid control apparatus, the piston of the actuator can be readily moved upon maintenance and repairs or inspection by releasing the cylinder chambers of the actuator to atmosphere.

1 Claim, 5 Drawing Sheets

FLUID CONTROL APPARATUS

This is a continuation-in-part of application Ser. No. 07/362,854, filed Jun. 7, 1989.

BACKGROUND OF THE INVENTION present invention relates to a fluid control apparatus, especially, a fluid control apparatus which communicates with an actuator, having a piston mounted therein capable of reciprocating movement by fluid pressure, with a fluid supply passage and a return passage.

The present invention is intended to provide a fluid control apparatus of the above-described type which has a blow down valve characteristic so that said piston is allowed to move only in one direction by an external force when supply of fluid to said actuator is stopped because at least one of said supply passage and said return passage is damaged.

The present invention is also intended to provide a fluid control apparatus of the above-described type which includes a manually operable mechanism by which the piston of the actuator can be moved by an external force, such as a manual force, regardless of supply of fluid when the members connected to the actuator or the actuator itself are serviced or checked.

As disclosed in U.S. Pat. No. 4,269,111, generally speaking, during flight, a spoiler of an airplane has a tendency to be pushed upwardly by lift generated by differential pressure between its upper and lower surfaces. Usually, an actuator, i.e., a fluid cylinder, is connected to the spoiler, and the spoiler is pressed downwardly by the fluid cylinder.

When the spoiler is required to be vertically moved, hydraulic pressure is supplied to the cylinder chambers.

When the hydraulic pressure source is damaged because of some reasons under a condition wherein the hydraulic pressure has been supplied to the actuator so as to lift the spoiler, it is necessary for the spoiler to be returned to a normal position by wind pressure acting on the spoiler or an external force acting on the spoiler due to flight attitude.

However, in a conventional apparatus, since one cylinder chamber of the actuator is not communicated with the other cylinder chamber, hydraulic oil exhausted from said one cylinder chamber is not supplied to said the other cylinder chamber. Accordingly, the other cylinder chamber will be supplied with hydraulic oil from a hydraulic pressure source.

When the hydraulic pressure source is damaged in such a conventional apparatus while the spoiler has been lifted, the spoiler is pressed by means of wind pressure acting on the spoiler which is caused by adjustment of the wind pressure acting on the spoiler or the flight attitude, and accordingly, the hydraulic oil is exhausted from the one cylinder chamber to which the spoiler is connected, and the piston is moved backwardly Due to the backward movement of the piston, the other cylinder chamber sucks hydraulic oil. In this case, as described above, said one cylinder chamber is not communicated with said the other cylinder chamber, and therefore, hydraulic oil is sucked through a valve at a high speed. Consequently, there occurs cavitation in the sucked hydraulic oil or suction of external air through the damaged hydraulic pressure source.

Partial vacuums are formed in the hydraulic oil in the cylinder chamber of the actuator because of the above described cavitation or suction of air. Thus, the piston of the actuator cannot be held at a predetermined position because of existence of the vacuums. As a result, there is a problem that the spoiler connected to the actuator cannot be secured at a predetermined position.

Further, when maintenance and repairs, or inspection of the spoiler or the fluid cylinder is done in such a conventional apparatus, the spoiler or the piston of the actuator cannot be readily moved by manual operation because the hydraulic pressure in the cylinder, i.e., the actuator, is not released.

SUMMARY OF THE INVENTION

It is an object of the present invention to provide a fluid control apparatus, by which even when the hydraulic pressure source is damaged for some reason while the spoiler is lifted, the spoiler can be lowered to a normal position by means of wind pressure acting on the spoiler which is caused by adjustment of the wind pressure acting on the spoiler or the flight attitude, while no cavitation or suction of external air is caused during the lowering of the spoiler. As a result, the piston of the actuator, and accordingly, the spoiler can be surely held at a predetermined position. Consequently, an accident, such as a crash, which may be caused by the lifted spoiler can be prevented from occurring.

It is another object of the present invention to provide a fluid control apparatus by which the piston of the actuator can be readily moved upon maintenance and repairs or inspection by releasing the cylinder chambers of the actuator to atmosphere.

According to the present invention, the first object is achieved by a fluid control apparatus which communicates an actuator, having a piston mounted therein capable of reciprocating motion by fluid pressure, with a fluid supply passage and a return passage, which further comprises:

a hydraulic passage which is capable of communicating with cylinder chambers located at both sides of the piston; and a check valve which is opened by hydraulic pressure generated by backward movement of the piston;

whereby the fluid control apparatus has a blow down valve characteristic so that the piston is allowed to move only in one direction by an external force when supply of fluid to the actuator is stopped because at least one of the supply passage and the return passage is damaged.

In addition, according to the present invention, the second object is achieved by a fluid control apparatus which communicates an actuator, having a piston mounted therein capable of reciprocating motion by fluid pressure, with a fluid supply passage and a return passage, which further comprises:

a retainer which communicates the return passage with the hydraulic passage capable of communicating with cylinder chambers of the actuator; and a manually operable member which is used to locate the retainer at a position wherein the return passage is communicated with the hydraulic passage.

According to the present invention, the cylinder chambers located at both the sides of the piston of the actuator are communicated with each other by means of the fluid control apparatus. The check valve is disposed within the communicating passage and is opened by the hydraulic pressure generated by the backward movement of the piston. Accordingly, even when the hydraulic pressure source is damaged under the condition wherein the spoiler is lifted, the check valve is opened by the external force which so acts as to backwardly move the actuator. As a result, the piston of the actuator is moved backwardly, and the spoiler returns to its normal position.

Further, according to the present invention, when the return passage is communicated by operation of a manually operable member, which passages are communicated with the cylinder chambers, respectively. The cylinder chambers are communicated with the tank, and at the same time, the actuator becomes free from the pump. Accordingly, the piston can be manually moved.

BRIEF DESCRIPTION OF THE DRAWINGS

An embodiment of the present invention will now be explained with reference to the accompanying drawings, wherein:

FIG. 1 shows a stationary condition;

FIG. 2 shows a normal operational condition wherein hydraulic pressure is supplied from a hydraulic pressure source;

FIG. 3 shows an operational condition wherein the fluid in the actuator is thermally expanded after the supply of the hydraulic pressure is stopped;

FIG. 4 shows a condition wherein the piston of the actuator can be moved by an external force acting on the piston of the actuator in a direction for returning the piston after at least one of the hydraulic pressure supply passage and the return passage is damaged; and FIG. 5 shows a condition wherein the piston can be moved by an external force such as a manual force after the manually operable cam is operated.

DETAILED DESCRIPTION OF THE INVENTION

As it will be apparent from the following description, the following embodiment of a fluid control apparatus according to the present invention has the following elements integrally mounted therein;

a pressure switching valve which opens and closes the pressure fluid passage in accordance with the supply pressure;

a hold down valve which seals one of the cylinder chambers and temporarily holds the movement of piston in one direction;

a thermal relief valve which prevents the cylinder from being damaged by the thermal expansion of the fluid filled in the temporarily sealed cylinder chamber;

a blow down valve which moves the piston by an external force when the fluid supply passage to the actuator or the return passage is damaged so that the fluid exhausted from one cylinder chamber is fed into the other cylinder chamber, and accordingly, it limits the movement of the piston in one direction; and a manually operable mechanism by operation of the cam, the piston of which can be slid by an external force regardless of existence of fluid when maintenance and repairs, or inspection is performed.

FIGS. 1 to 5 are cross sectional views of a fluid control apparatus of the present invention and show different conditions.

Figure 1:
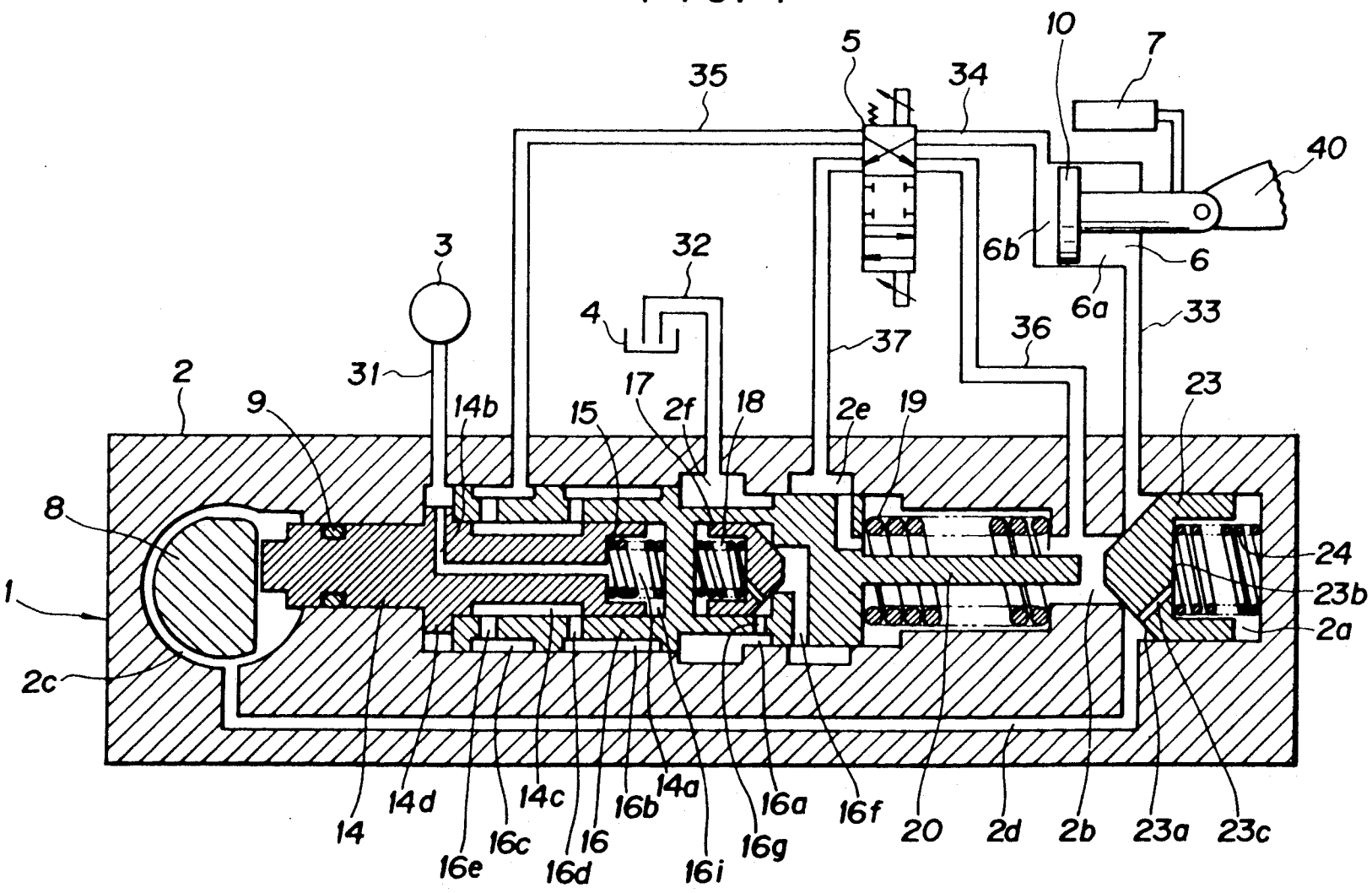
FIGS. 1 to 5 are cross sectional views of a fluid control apparatus of the present invention and show different conditions, more specifically.

FIG. 1 shows a stationary condition, wherein the system is stopped. Reference numeral 1 schematically denotes a fluid control apparatus, and a body of which is denoted by reference numeral 2.

The fluid control apparatus 1 supplies an actuator 6 for actuating a spoiler 40 (see FIG. 1) of an airplane with fluid. The actuator 6 has a piston 10 mounted therein movably forwardly and backwardly. When the piston 10 is moved forwardly and is extended, the spoiler 40 is lifted, and the spoiler 40 is lowered when the piston 10 is moved backwardly.

A position detector 7 detects the position of the piston 10.

The body 2 has a cavity **2*a* with a circular cross section for accommodating a check valve 23, a cavity 2*b* for accommodating a slider 16, and a cavity 2*c* with a circular cross section for accommodating a manually operable cam 8, formed therein successively from the right to the left. The cavities 2*a*, 2*b* and 2*c* are connected to each other, and the junction between the cavities 2*a* and 2*b* is communicated with the cavity 2*c* by a hydraulic passage 2*d***.

The cylindrical slider 16 is slidably and sealingly inserted into the cavity **2*b***.

The right end of the slider 16 projects in a bar shape and forms a rod 20. The slider 16 has an annular groove **16*a*, an annular groove 16*b* and an annular groove 16*c***, formed thereon successively from the right to the left.

The slider 16 has a cavity **16*i* formed at the left side thereof, and a spool 14 having circular cross section is slidably and sealingly inserted in the cavity 16*i***.

The spool 14 has a small cavity **14*a* formed at the right side thereof. A spring 15 is disposed in the small cavity 14*a* in such a manner that it locates between the spool 14 and the internal wall of the slider 16 and that it urges the spool 14** to the left.

The small cavity **14*a* is communicated with a shoulder portion 14*d*, which is formed at the periphery of the spool 14, via a communicating passage 14*b* so that it is capable of being communicated with a fluid supply source 3, such as a pump. The spool 14 has an annular groove 14*c*** formed at the outer surface thereof.

A seal 9 is made of an elastic material and is disposed between the spool 14 and the cavity **2*b* of the body 2**.

The annular groove **16*b* of the slider 16 is capable of communicating with the annular groove 14*c* of the spool 14 via a communicating passage 16*d*. In addition, the annular groove 16*c* of the slider 16 is capable of communicating with the annular groove 14*c* of the spool 14 via a communicating passage 16*e***.

A valve 17 having a cone-shaped front is disposed in a small right cavity of the slider 16 and is urged to the right by a spring 18, and thus, a check valve is formed.

The seat surface of the valve 17 can be communicated with an annular groove **2*e*, which is formed in the body 2, via a communicating passage 16*f*. The small right cavity accommodating the valve 17 is communicated with the annular groove 16*a* of the slider 16 via a communicating passage 16*g***.

A spring 19 is disposed between the right front side of the slider 16 and the right shoulder of the cavity **2*b* of the body 2 so that the slider 16 is urged to the left. disposed in the right cavity 2*a* which is formed in the body 2, and a spring 24 is disposed between the check valve 23 and the right inner wall of the body 2. As a result, the check valve 23 is urged to the left. The check valve 23 has a communicating passage 23*c* formed therein which communicates the inside and the outside of the check valve 23** with each other.

The right cavity 2a of the body 2 and a right cylinder chamber 6a of the actuator 6 are communicated with each other by means of a passage 33.

A left cylinder chamber 6b of the actuator 6 is communicated with a port of a control valve 5.

The control valve 5 is a three position control valve actuated by an electro-magnetic solenoid. Generally, when the electric power source is switched off or when the hydraulic system is broken, for example, upon a breakdown of the hydraulic pump, or damage to the supply passage or return passage, the control valve 5 is urged in one direction by a spring to the condition illustrated in FIG. 1.

One of inlet ports of the electro-magnetic valve 5 is communicated with the actuator 6 via the passage 34 as described above, and the other inlet port is communicated with the right end portion of the cavity 2b, which is formed in the body 2 of the fluid control apparatus 1, via passage 36.

Two outlet ports of the control valve 5 are communicated with the fluid control apparatus 1 via passages 35 and 37. The fluid control apparatus 1 is further communicated with a tank 4 via return passage 32.

The passage 35 is communicated with the annular groove 16c formed near the left end of the slider 16. The passage 37 is communicated with an annular groove 2e facing the right portion of the slider 16. The return passage 32 is opened in the annular groove 16a formed at the intermediate portion of the slider 16.

Figure 4:
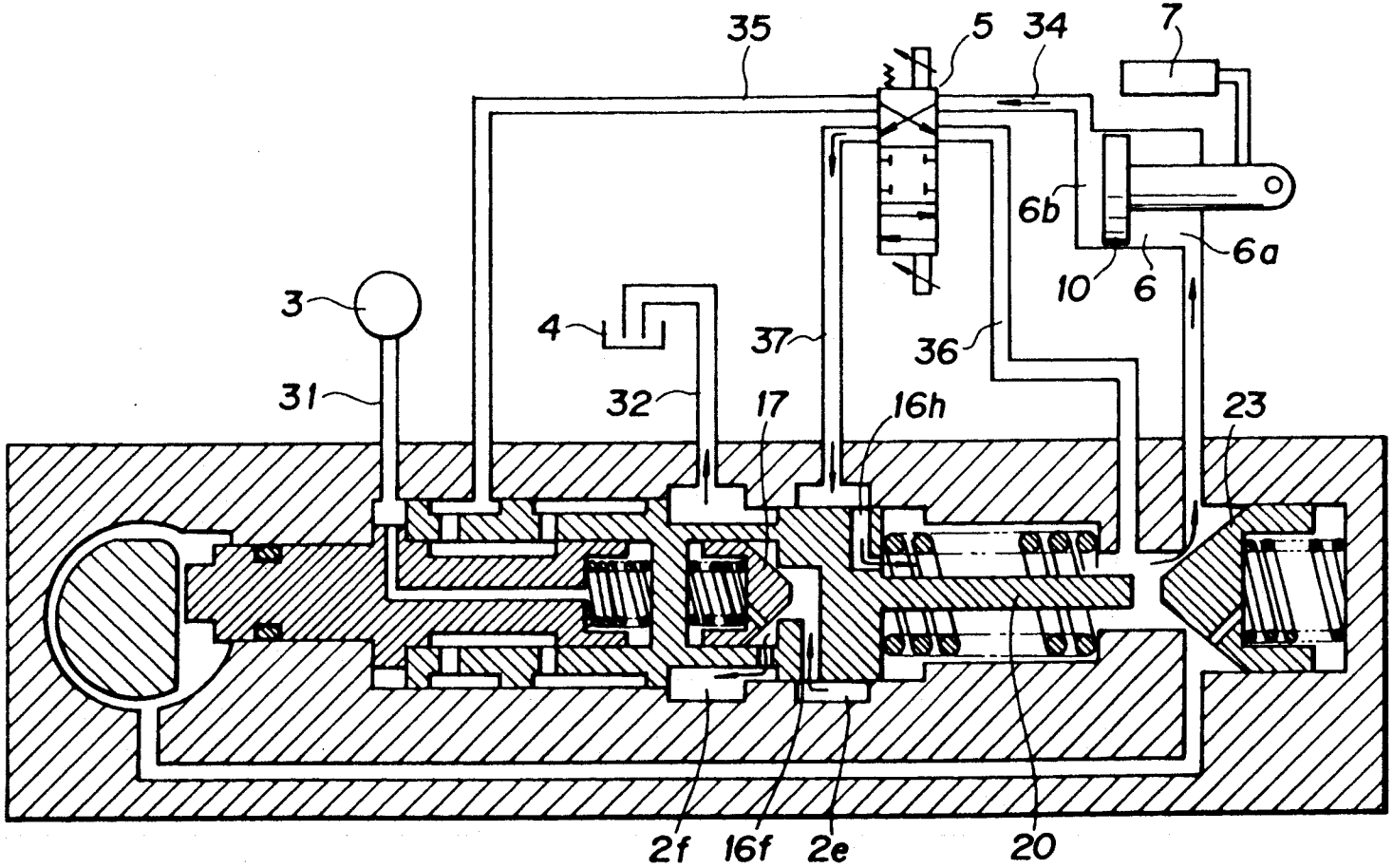

A portion adjacent to the rod 20, which is formed at the front end of the slider 16, is communicated with the annular groove 2e, which faces the right portion of the slider 16, via a passage 16h (see FIG. 4).

When the present system is stopped, the condition illustrated in FIG. 1 takes place. More specifically, the spool 14 is pressed to the left by springs 15 and 19, and its shoulder portion 14d abuts with the left wall of the cavity 2b of the body 2. The slider 16 is urged by the spring 19, and its left end abuts with the right side of the shoulder portion 14d of the spool 14. Accordingly, the front end of the rod 20 no longer abuts the check valve 23, and the check valve 23 is closed by the spring 24. Consequently, the fluid supply source 3 is communicated with the shoulder portion 14d of the spool 14 via the supply passage 31, and is further communicated with the small cavity 14a through the communicating passage 14b. The tank 4 is communicated with the annular groove 2f through the return passage 32. Although the annular grooves 2f and 16a are aligned with each other, the pressure fluid does not flow since the check valve 17 is closed. The passage 35 opens in the annular groove 16c, which is communicated with the annular groove 16b through the communicating passage 16e, the annular groove 14c and the communicating passage 16d. The passage 37 is communicating with the annular groove 2e, and the passage 36 is communicating with the cavity 2b.

Figure 2:
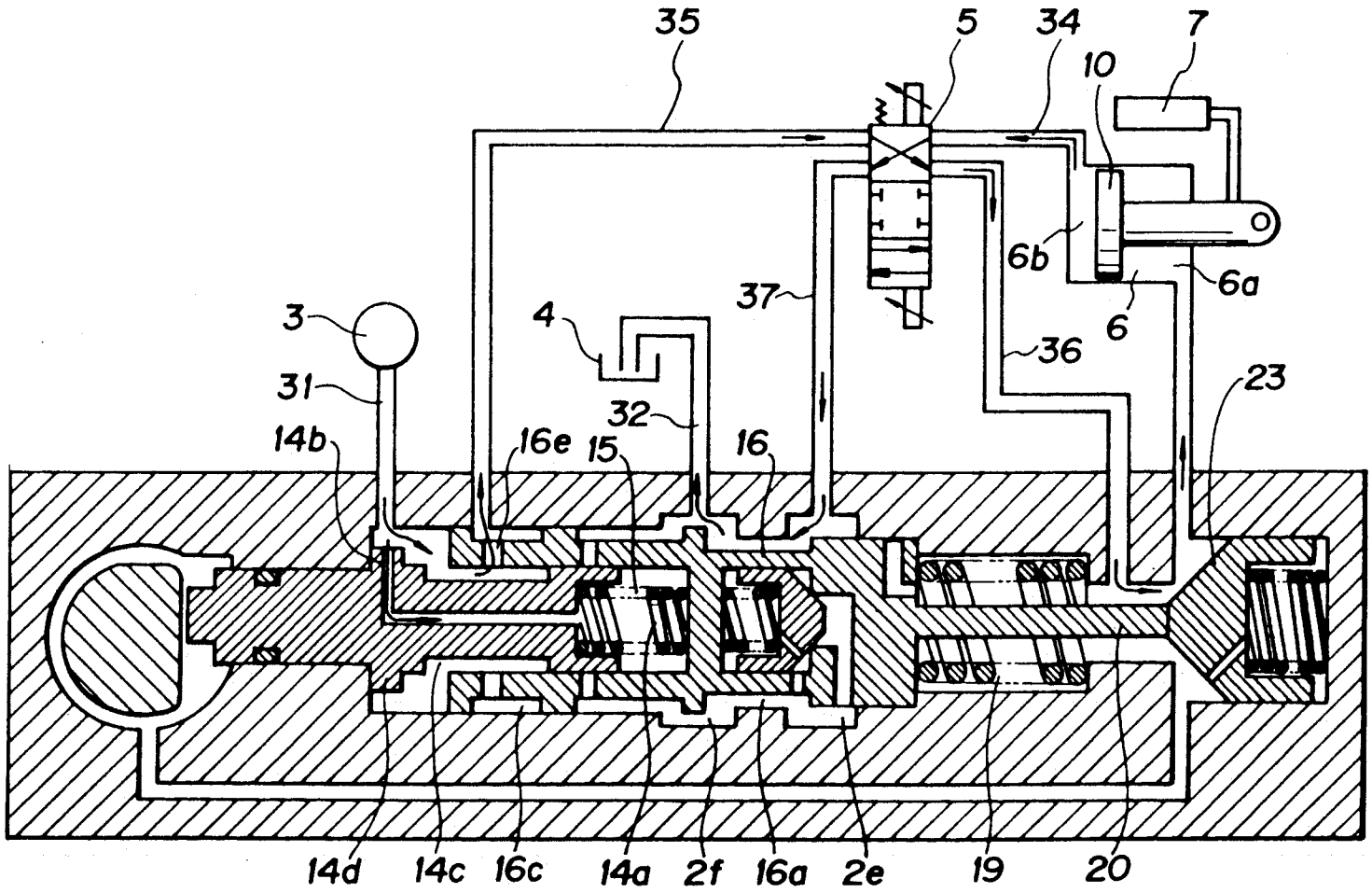

FIG. 2 shows the normal operational condition where hydraulic pressure is supplied from the fluid supply source 3 to the fluid control apparatus 1 which is constructed in such a manner as described above.

Hydraulic pressure is supplied from the fluid supply source 3 along a line indicated by an arrow to the left side of the slider 16, and further to the cavity 14a through the communicating passage 14b. The slider 16 is moved to the right against the spring 19, and the annular groove 14c of the spool 14 opens in the supply passage 31.

The supplied hydraulic pressure is transmitted from the side of the slider 16 to the passage 35 through the annular groove 14c of the left side of the spool 14, the communicating passage 16e and the annular groove 16c formed on the outer surface of the slider 16, and then is transmitted to the control valve 5.

Due to the movement of the slider 16 to the right, the annular groove 2e formed in the body 2, the annular groove 16a formed on the slider 16 and the annular groove 2f formed in the body 2 are communicated with each other, and the hydraulic pressure from the control valve 5 returns to the return passage 32 and the tank 4 through the passage 37, and the annular grooves 2e, 16a and 2f.

The hydraulic pressure supplied to the control valve 5 flows in the left cylinder chamber 6b of the actuator 6 through the passage 34 or, as illustrated in FIG. 2, in the right cylinder chamber 6a of the actuator 6 through the passage 36 in accordance with the switching direction of the control valve 5.

In this case, the check valve 23 is opened by the front end of the rod 20 due to the movement of the slider 16 to the right, and it supplies the actuator 6 with hydraulic fluid as illustrated in FIG. 2 or it does not prevent the flow exhausted from the actuator 6.

When the supply of fluid from the fluid supply source 3 is stopped under the condition illustrated in FIG. 2, the pressure supplied into the right cavity 14a of the spool 14 is decreased. Thus, the slider 16 moves to the left until the left side surface of the slider 16 abuts with the shoulder portion 14d of the spool 14. Thus, the slider 16 returns into a condition illustrated in FIG. 1 and the supply of fluid between the fluid supply source 3 and the control valve 5 is stopped.

The fluid control apparatus is opened and closed by the movement of the slider 16 in accordance with the fluid pressure as described above.

Further, since the check valve 23 is closed when the slider 16 is in a condition illustrated in FIG. 1, the actuator 6 keeps fluid being accommodated in the cylinder chambers 6a and 6b.

Under this condition, if the cylinder chambers 6a and 6b are heated, for example, when an airplane lowers from the high altitude where the ambient temperature is low to the low altitude where the ambient temperature is normal, the liquid confined in the cylinder chambers 6a and 6b of the actuator 6 is thermally expanded.

In such a case, unless the liquid in the cylinder chambers 6a and 6b can be released, the actuator 6 will be damaged.

According to the present invention, in order to avoid damage of the actuator 6 under the above described condition, the check valve 23 is opened by the fluid in the cylinder chambers 6a and 6b of the actuator 6, the pressures of which have been raised.

Figure 3:
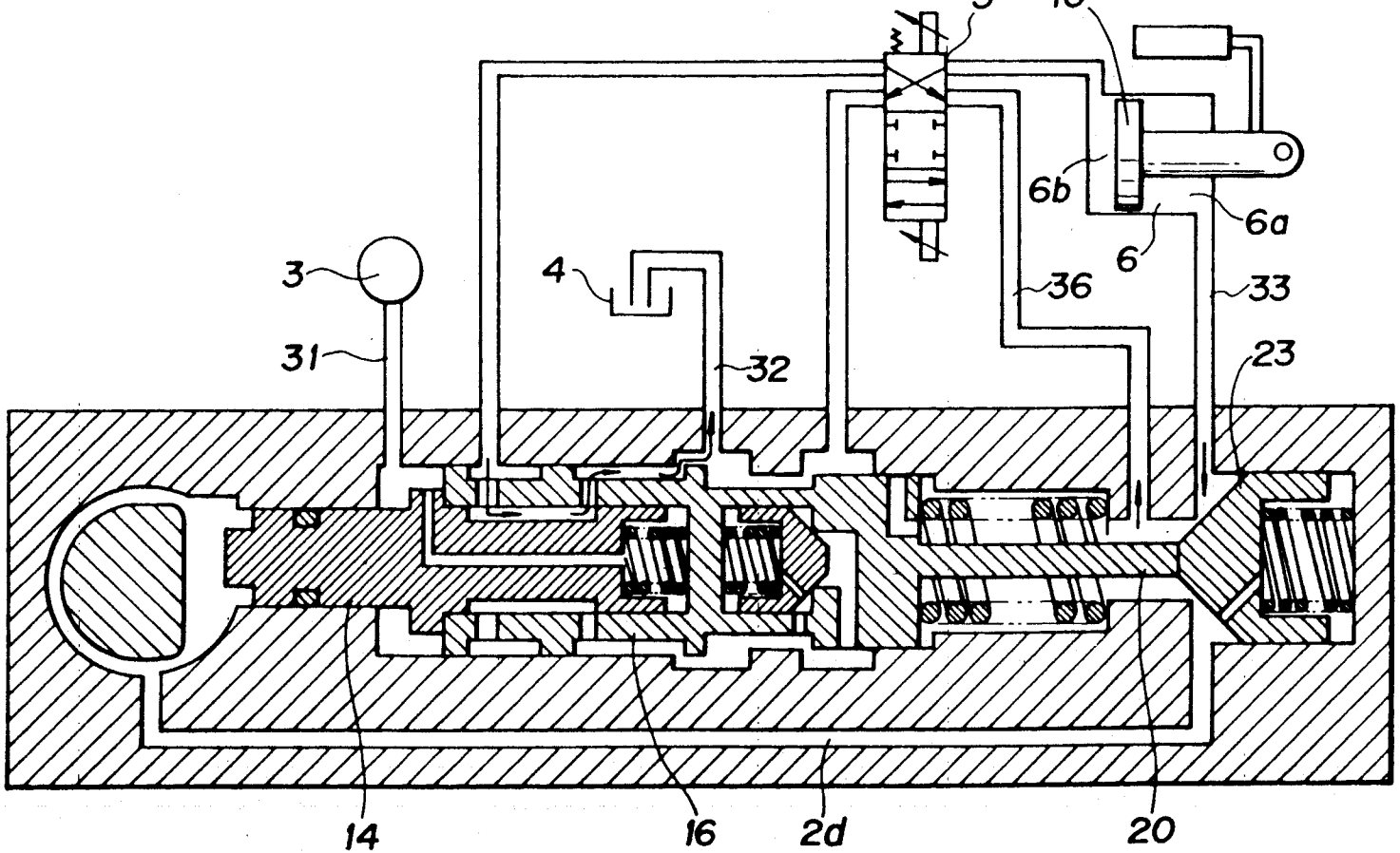

FIG. 3 shows an operational condition wherein the fluid in the actuator is thermally expanded after the supply of the hydraulic pressure is stopped;

In FIG. 3, the right cylinder chamber 6a of the actuator 6 is communicated with the junction between the cavities 2a and 2b through the passage 33, and from the junction, the pressure is supplied to the left side surface of the spool 14 through the passage 2d which communicates the cavities 2a and 2b with each other. As the pressure supplied to the left side surface of the spool 14 is raised, the spool 14 moves to the right, and accordingly, the slider 16 is moved to the right. Thus, the check valve 23 is opened by the rod 20 projecting from the front end of the slider 16. As a result, the cylinder chambers 6a and 6b of the actuator 6 are communicated with the return passage 32 as illustrated in FIG. 3, and the fluid which has been confined in the cylinder chambers 6a and 6b returns to the tank 4 through the return passage 32 as indicated by arrows.

FIG. 4 shows a condition wherein after at least one of the hydraulic pressure supply passage 31 and the return passage 32 is damaged or the supply from the pump is stopped, the fluid exhausted from the left cylinder chamber 6b is introduced into the right cylinder chamber 6a by an external force acting on the piston 10 of the actuator 6 in a direction for returning the piston 10, while the surplus fluid depending on the decreased cross section of the right cylinder chamber 6a by the piston rod of the piston 10 is exhausted to the outside through the check valve 17.

As previously described, the control valve 5 includes a spring so that it is urged in one direction by the spring when the hydraulic system is broken. As also already described, there may occur a serious problem if the spoiler is lifted for a certain degree, when the hydraulic pressure source is damaged. If the above described condition continues, there occurs a problem of a crash, since the spoiler is not in a normal position.

Even under such a condition, it is possible that the spoiler receives a downward force by wind pressure acting on the spoiler or by control of flight attitude by a pilot. A force for moving the piston 10 of the actuator 6 to the left acts on the piston 10 due to the downward force.

Thus, the pressure in the left cylinder chamber 6b is increased, and enters into the annular groove 2e through the passage 34, the control valve 5 and the passage 37. The pressure entered into the annular groove 2e acts on the check valve 23 after it passes the communicating passage 16h and the side of the rod 20. Since the pressure in the cylinder chamber 6b is higher than that in the cylinder chamber 6a, the pressure opens the check valve 23, and accordingly, the pressure in the cylinder chamber 6b flows into the cylinder chamber 6a, and the the piston 10 of the actuator 6 is allowed to move to the left. Since the cross section of left cylinder chamber 6b is larger than that of the right cylinder chamber 6a by the cross section of the rod 20, fluid will be surplus if the fluid displaced from the left cylinder chamber 6b directly flows into the right cylinder chamber 6a.

Accordingly, in the present invention, the valve 17 receives pressure which is transmitted through the annular groove 2e formed in the body 2 and the communicating passage 16f. The valve 17 is a check valve, which is opened in accordance with the pressure acting thereon, and the surplus fluid is returned to the annular groove 2f which is communicating with the return passage 32.

Referring to FIG. 1, it is well known that the springs 18 and 24 which bias check valves 17 and 23 respectively closed, obey Hooke's law, namely $F = -kx$, (after Robert Hooke, 1635–1703) where the force F exerted by the spring is equal to the displacement x of the spring multiplied by a known force constant k of the spring. The minus sign indicates that the force F is always opposite to the direction of displacement x of the spring. Thus, for a compressed spring, the force F is in the direction of spring expansion, and for a stretched spring, the force F is in the direction of spring compression. From Hooke's law, the force constants of springs 18 and 24 are chosen so that the check valves 17 and 23 open in the proper sequence for the apparatus to operate as described above.

In particular, the force constant of spring 24 should preferably be chosen so that check valve 23 opens to allow chamber 6a to be filled, before check valve 17 opens. Thus, the force constant k of spring 24 should be smaller than the force constant k of spring 18, so that the force exerted on valve 17 is greater than the force exerted on valve 23; thus, the pressure on check valve 17 will build back up to open the valve 17 only after chamber 6a is completely filled.

It is possible that the check valve 17 is disposed between the return passage 32 and the passage 37. However, the check valve 17 according to the present embodiment has better durability than the above described alternative because the check valve of the present embodiment does not operate under the normal condition.

Figure 5:
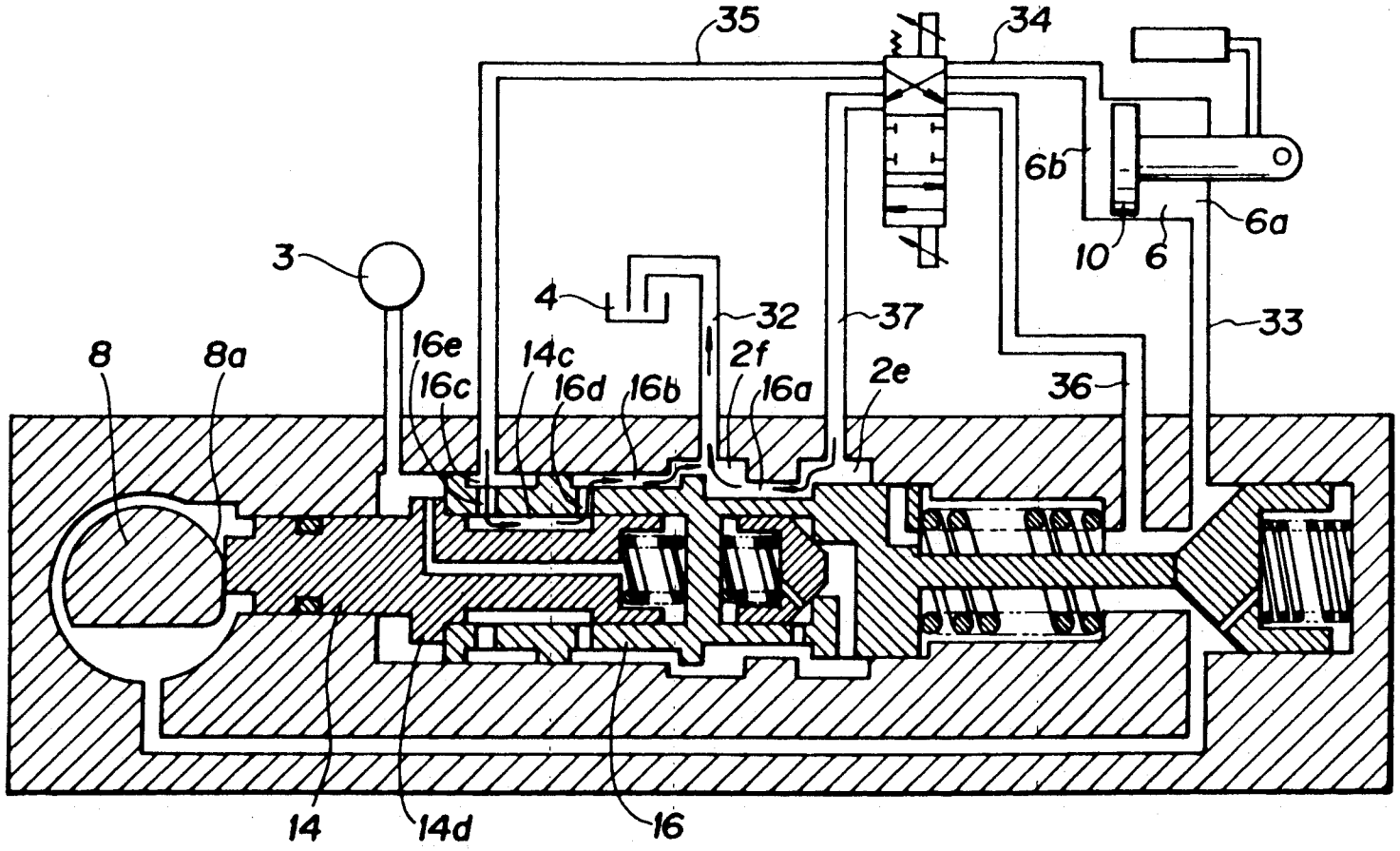

FIG. 5 shows a condition wherein the piston 10 of the actuator 6 can be moved by an external force such as a manual force after the manually operable cam 8 is operated. Such a condition is required for maintenance, repairs and inspection. More specifically, the cam 8 is turned in a clockwise direction, and the spool 14 is pressed to the right by the cam surface 8a of the cam 8. The shoulder portion 14d of the spool 14 presses the left side surface of the slider 16. Under this condition, the communicating passages 35 and 37 of the control valve 5 communicate with the return passage 32 communicating with the tank 4, respectively, via the annular groove 16c, the communicating passage 16e, annular groove 14c, the communicating passage 16d, and the annular grooves 16d, 16b and 2f, or the annular grooves 2e, 16a and 2f.

As a result, the liquid which has been stored in the cylinder chambers 6a and 6b of the actuator 6 is returned to the tank 4 through the return passage 32, and accordingly, the actuator 6 can be readily and easily moved by an external force, such as manual operation. Should fluid pressure be supplied from the fluid supply source 3 under this condition, as it is apparent from FIG. 5, the fluid pressure is closed and does not act on the actuator 6.

As is apparent from the foregoing explanation, according to the present invention, a fluid control apparatus is provided, by which even when hydraulic pressure source is damaged by some reasons while the spoiler has been lifted, the spoiler can be lowered to a normal position by means of wind pressure acting on the spoiler which is caused by adjustment of the wind pressure acting on the spoiler or the flight attitude, and as a result, an accident, such as a crash, which may be caused by the lifted spoiler can be prevented.

Further, according to the present invention a fluid control apparatus is provided, by which the piston of the actuator can be readily moved upon maintenance and repairs or inspection by releasing the cylinder chambers of the actuator to atmosphere.

What is claimed is:

1. A fluid control apparatus, comprising:

an actuator, having a first fluid chamber (6a) and a second fluid chamber (6b);

a flow directional control valve (5);

a pilot valve means (1) which is operated by a pilot pressure from a fluid supply source (3);

first supply and return passages (33, 36) which communicate said first fluid chamber (6a) with said flow direction control valve (5), an intermediate portion of said first supply and return passages being formed in said pilot valve means (1);

a second supply and return passage (34) which communicates said second fluid chamber (6*b*) with said flow directional control valve (5);

a first intermediate passage (35) and a second intermediate passage (37) which communicate said pilot valve means (1) with said flow directional control valve (5); and a fluid supply passage (31) and a fluid exhaust passage (32) which are communicated with said pilot valve means (1), said flow directional control valve (5) selectively communicating one of said first intermediate passage (35) and said second intermediate passage (37) with said first supply and return passages (33, 36) and the other of said first intermediate passage (35) and said second intermediate passage (37) with said second supply and return passage (34);

said pilot valve means (1) including a check valve means (23) which is disposed in said intermediate portion of said first supply and return passages (33, 36) and which prevents flow from said first fluid chamber (6*a*);

a first valve means (14, 16, 16*e*) which permits fluid flow between said fluid supply passage (31) and said first intermediate passage (35) when said fluid supply passage (31) is supplied with fluid from said fluid supply source (3) and which stops fluid flow between said fluid supply passage (31) and said first intermediate passage (35) when said fluid supply passage (31) is not supplied with fluid from said fluid supply source (3);

a second valve means (2*e*, 2*f*, 16) which permits fluid flow between said fluid exhaust passage (32) and said second intermediate passage (37) when said fluid supply passage (31) is supplied with fluid from said fluid supply source (3) and which stops fluid flow between said fluid exhaust passage (32) and said second intermediate passage (37) when said fluid supply passage (31) is not supplied with fluid from said fluid supply source (3);

a third valve means (2*e*, 2*b*, 16) which stops fluid flow between said second intermediate passage (37) and said intermediate portion of said first supply and return passages (33, 36) when said fluid supply passage (31) is supplied with fluid from said fluid supply source (3) and which permits fluid flow between said second intermediate passage (37) and said intermediate portion of said first supply and return passages (33, 36) when said fluid supply passage (31) is not supplied with fluid from said fluid supply source (3); and a pusher means which pushes said check valve means (23) so as to permit fluid flow from said fluid chamber (6*a*) when said fluid supply passage (31) is supplied from fluid from said fluid supply source (3).

* * * * *

UNITED STATES PATENT AND TRADEMARK OFFICE

CERTIFICATE OF CORRECTION

PATENT NO. : 5,174,189

DATED : December 29, 1992

INVENTOR(S) : Toshio Kamimura

It is certified that error appears in the above-identified patent and that said Letters Patent is hereby corrected as shown below:

On the title page, in the Abstract
line 4, do not start a new paragraph;
line 5, "comprises" should be --has--;
line 10, do not start a new paragraph;
lines 11 and 12, delete "has a blow down valve characteristic so that the piston";
delete lines 16-23 in their entirety and do not start a new paragraph.

Col. 1, line 8, before "present" insert --The--.

Col. 1, line 58, "wardly" should be --wardly.--.

Col. 4, line 61, after "left." start a new paragraph and insert --A check valve 23 has a cone-shaped front end and is--.

Col. 10, line 28, "from" (1st occurrence) should be --with--.

Signed and Sealed this

Twenty-sixth Day of October, 1993

*Attest:*

Bruce Lehman

BRUCE LEHMAN

*Attesting Officer*

*Commissioner of Patents and Trademarks*